US011646169B2

(12) United States Patent
Chou

(10) Patent No.: US 11,646,169 B2
(45) Date of Patent: May 9, 2023

(54) ROLLING-BALL TILT SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 0 days.

(21) Appl. No.: 17/829,689

(22) Filed: Jun. 1, 2022

(65) Prior Publication Data

US 2023/0021545 A1 Jan. 26, 2023

(30) Foreign Application Priority Data

Jul. 21, 2021 (TW) ..... 110126765

(51) Int. Cl.
*H01H 21/22* (2006.01)
*H01H 21/04* (2006.01)

(52) U.S. Cl.
CPC ..... *H01H 21/22* (2013.01); *H01H 21/04* (2013.01)

(58) Field of Classification Search
CPC ..... H01H 21/22; H01H 11/04; H01H 35/14; H01H 35/141; H01H 35/025; H01H 21/04
USPC ..... 200/1 R, 52 R, 61.45 R–61.45 M, 61.52, 200/277, 329
See application file for complete search history.

(56) References Cited

U.S. PATENT DOCUMENTS 6,198,059 B1 * 3/2001 Jou ..... H01H 35/025 200/61.52
7,230,193 B2 * 6/2007 Chou ..... H01H 35/14 200/61.52

FOREIGN PATENT DOCUMENTS

TW 200612452 A 4/2006

OTHER PUBLICATIONS

Search Report appended to an Office Action, which was issued to Taiwanese counterpart application No. 110126765 by the TIPO dated Apr. 22, 2022, with an English translation thereof.

* cited by examiner

*Primary Examiner* — Edwin A. Leon
*Assistant Examiner* — Iman Malakooti

(57) ABSTRACT

A rolling-ball tilt switch includes a conductive housing having an inner surface that surrounds a longitudinal axis and that defines a roller cavity, an insulating seat inserted into the roller cavity, a conductive terminal having a protruding section extending through the insulating seat into the roller cavity, and a ball unit disposed in the roller cavity and moveable between a conducting position and a non-conducting position. The longitudinal axis and an extension of a surface portion of the inner surface of the conductive housing cooperatively define a first angle that ranges from 2 to 12 degrees.

10 Claims, 7 Drawing Sheets

ROLLING-BALL TILT SWITCH

CROSS-REFERENCE TO RELATED APPLICATION

This application claims priority to Taiwanese Invention Patent Application No. 110126765, filed on Jul. 21, 2021.

FIELD

The disclosure relates to a tilt switch, and more particularly to a rolling-ball tilt switch.

BACKGROUND

Referring to FIG. 1, Taiwanese Invention Patent No. TWI390563B discloses a conventional rolling-ball tilt switch 9, including a conductive housing 91, two rolling-balls 92, an insulating seat 93 and an electric terminal 94. The conductive housing 91 has an outer surface 911 that surrounds a central axis (C), an inner surface 913 that surrounds the central axis (C) and that defines a roller cavity 912, a rim surface 914 that interconnects the inner surface 913 and the outer surface 911 and that defines an opening 916 communicating with the roller cavity 912, and an enclosed part 915 that is opposite to the rim surface 914 along the central axis (C) and that is connected between the inner surface 913 and the outer surface 911. The two rolling-balls 92 are electrically conductive and disposed in the roller cavity 912, and are contained therein. The insulating seat 93 is installed on the conductive housing 91 so that the two rolling-balls 92 are contained within the roller cavity 912. The electric terminal 94 extends through the insulating seat 93 along the central axis (C) so as to cooperate with the insulating seat 93 to block the opening 916, and a tip of the electric terminal protrudes into the roller cavity 912. If the conventional rolling-ball tilt switch 9 is tilted so that at least one of the two rolling-balls 92 is concurrently in contact with the electric terminal 94 and the conductive housing 91, the conventional rolling-ball tilt switch 9 will be in a conducting state. Conversely, when both of the two rolling-balls 92 are separated from the electric terminal 94, the conventional rolling-ball tilt switch 9 will be in a non-conducting state.

Under a scenario where the conventional rolling-ball tilt switch 9 is placed parallel to a ground surface while remaining in the conducting statae, even a slight tilt causing a small change in angle relative to the ground surface may cause the conventional rolling-ball tilt switch 9 to switch to the non-conducting state. Therefore, the conventional rolling-ball tilt switch 9 is too sensitive to small angle adjustments and does not have the tolerance required to operate under a designated range of tilt angles. This makes the conventional rolling-ball tilt switch 9 unsuitable for many applications.

SUMMARY

Therefore, an object of the disclosure is to provide a rolling-ball tilt switch that can remain in a conducting state under a range of tilt angles.

According to the disclosure, a rolling-ball tilt switch is adapted to be electrically connected to a circuit board that is on a reference surface. The rolling-ball tilt switch includes a conductive housing, an insulating seat, a conductive terminal, and a ball unit.

The conductive housing is adapted to be secured to the circuit board, and has an inner surface, an outer surface, a rim end surface, and a distal end surface. The inner surface is adapted to surround a longitudinal axis parallel to the circuit board, and defines a roller cavity. The outer surface surrounds and is opposite to the inner surface. The rim end surface interconnects the inner surface and the outer surface. The distal end surface interconnects the inner surface and the outer surface, and is opposite to the rim end surface along the longitudinal axis. The inner surface has a first surface portion that is adjacent to the rim end surface, and a second surface portion that extends from the first surface portion along the longitudinal axis towards the distal end surface. The second surface portion has a first section connected to the first surface portion and gradually converging towards the distal end surface, and a second section connected to an end of the first section which is opposite to the first surface portion, and gradually converging towards the distal end surface.

The longitudinal axis and an extension of the first section of the second surface portion of the inner surface cooperatively define a first angle that ranges from 2 to 12 degrees. The longitudinal axis and an extension of the second section of the second surface portion of the inner surface cooperatively define a second angle that is not larger than 90 degrees and that is larger than the first angle.

The insulating seat is connected to the rim end surface and is fittingly inserted into the roller cavity.

The conductive terminal has a protruding section extending through the insulating seat into the roller cavity and cooperating with the insulating seat to seal an end of the roller cavity adjacent to the rim end surface; and The ball unit is disposed in the roller cavity, and is movable along the second surface portion between a conducting position, where the ball unit is concurrently in contact with the protruding section of the conductive terminal and the second surface portion, and a non-conducting position, where the ball unit is separated from the protruding section of the conductive terminal.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
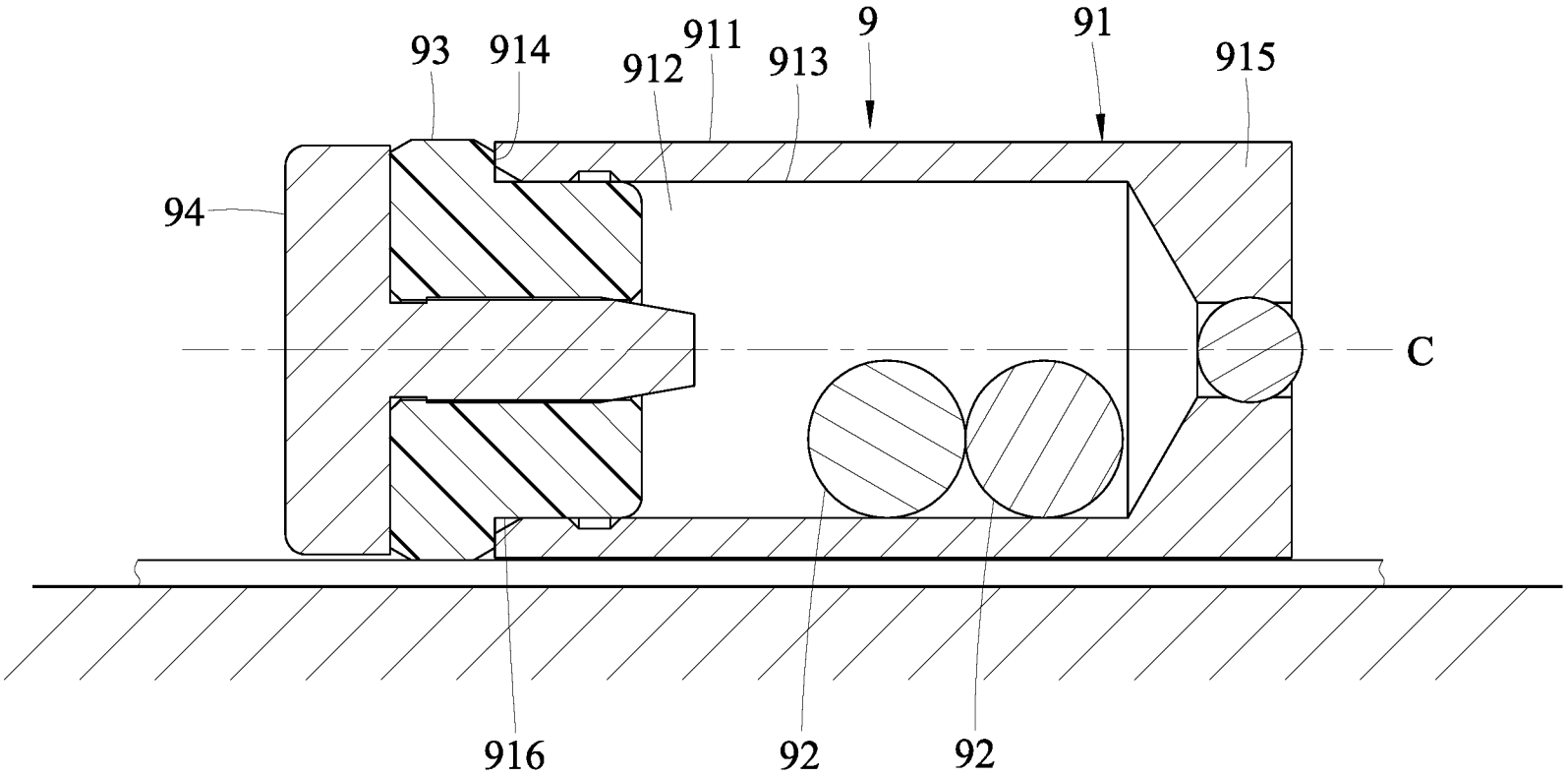
FIG.1 PRIOR ART
FIG. 1 is a sectional view illustrating a conventional rolling-ball tilt switch disclosed in Taiwanese Patent No. TWI390563B.
Figure 2:
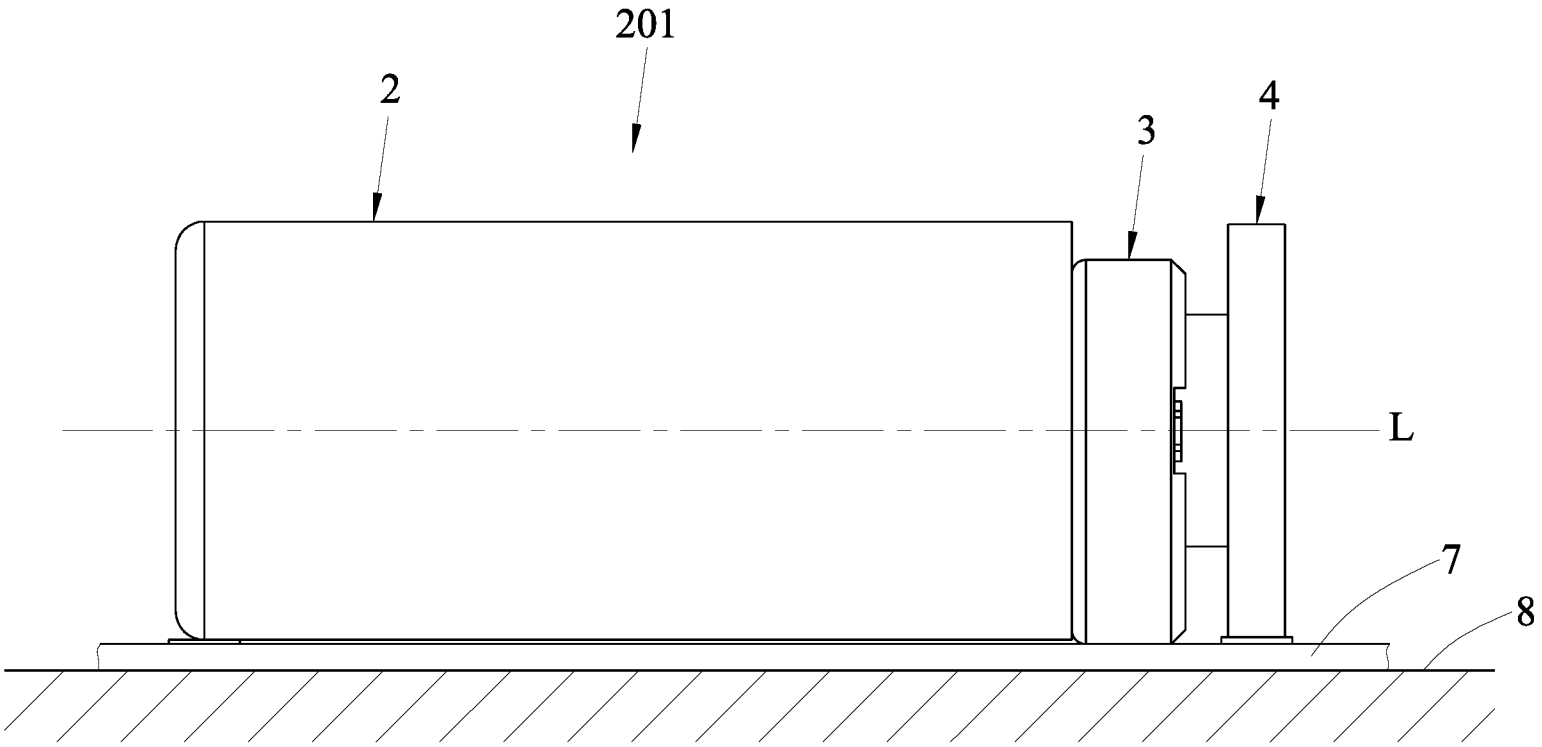
FIG. 2 is a side view illustrating a first embodiment of a rolling-ball tilt switch according to the present disclosure.
Figure 3:
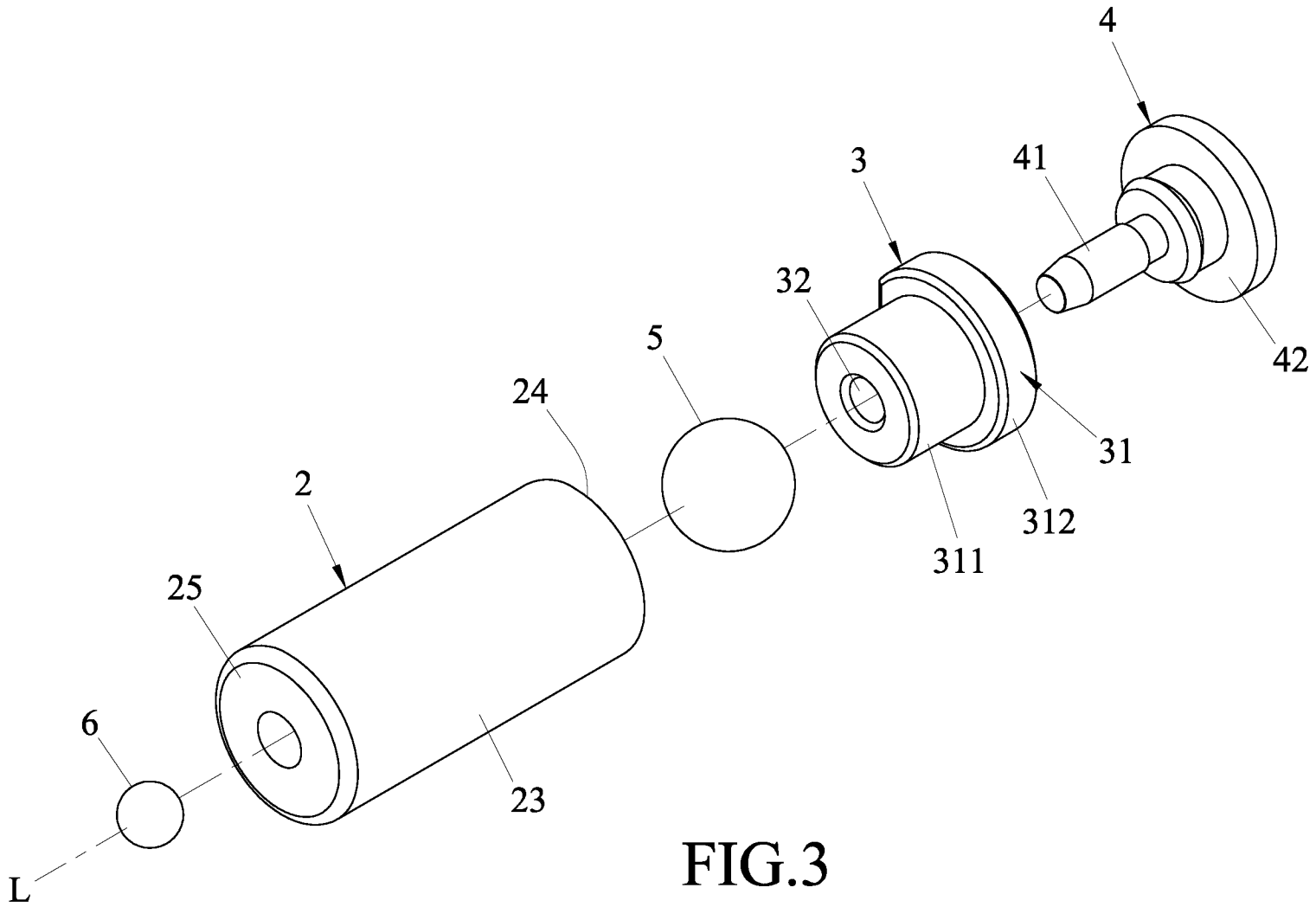
FIG. 3 is an exploded perspective view illustrating the first embodiment of the rolling-ball tilt switch.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 2 to 5, a first embodiment of a rolling-ball tilt switch 201 according to the present disclosure is adapted to be electrically connected to a circuit board 7 that is on a reference surface 8, and includes a conductive housing 2, an insulating seat 3, a conductive terminal 4, a ball unit 5, and a plugging sphere 6.

The conductive housing 2 is adapted to be secured to the circuit board 7, and has an inner surface 22, an outer surface 23, a rim end surface 24, and a distal end surface 25. The inner surface 22 is adapted to surround a longitudinal axis (L) parallel to the circuit board 7, and defines a roller cavity 21. The outer surface 23 surrounds and is opposite to the inner surface 22. The rim end surface 24 interconnects the inner surface 22 and the outer surface 23. The distal end surface 25 interconnects the inner surface 22 and the outer surface 23, and is opposite to the rim end surface 24 along the longitudinal axis (L).

The inner surface 22 has a first surface portion 221 that is cylindrical and that is adjacent to the rim end surface 24, and a second surface portion 222 that extends from the first surface portion 221 along the longitudinal axis (L) towards the distal end surface 25. The second surface portion 222 has a first section 225 connected to the first surface portion 221 and gradually converging towards the distal end surface 25, and a second section 226 connected to an end of the first section 225 which is opposite to the first surface portion 221, and gradually converging towards the distal end surface 25. The longitudinal axis (L) and an extension of the first section 225 of the second surface portion 222 of the inner surface 22 cooperatively define a first angle (θ1) that ranges from 2 to 12 degrees. The longitudinal axis (L) and an extension of the second section 226 of the second surface portion 222 of the inner surface 22 cooperatively define a second angle (θ2) that is not larger than 90 degrees and that is larger than the first angle (θ1). It should be noted that in some embodiments the second angle (θ2) may range from 60 to 80 degrees. More specifically, in the first embodiment, the first angle (θ1) is substantially 4 degrees, and the second angle (θ2) is substantially 60 degrees.

The insulating seat 3 is connected to the rim end surface 24, and has a base body 31 that surrounds the longitudinal axis (L), and an insertion hole 32 that extends along the longitudinal axis (L) through the base body 31. The base body 31 has an annular plug section 311 that is fittingly inserted into the roller cavity 21 of the conductive housing 2 and that abuts against the first surface portion 221 of the inner surface 22, and an annular sealing section 312 that is connected to the annular plug section 311, that has a diameter larger than that of the annular plug section 311 and that abuts against the rim end surface 24. The insertion hole 32 is a stepped hole, and has a large hole section 321 that is formed in the annular sealing section 312 of the base body 31, and a small hole section 322 that has a diameter smaller than a diameter of the large hole section 321, and that extends from the large hole section 321 through the annular plug section 311 of the base body 31 into the roller cavity 21.

The conductive terminal 4 has a terminal head 42 that is fittingly inserted into the large hole section 321 of the insertion hole 32. The conductive terminal 4 further has a protruding section 41 extending from the terminal head 42 through the insulating seat 3 into the roller cavity 21 and cooperating with the insulating seat 3 to seal an end of the roller cavity 21 adjacent to the rim end surface 24. More specifically, the terminal head 42 has a diameter larger than that of the protruding section 42, and the protruding section 41 extends from the terminal head 42 through the small bore section 322 of the insertion hole 31 into the roller cavity 21.

Figure 4:
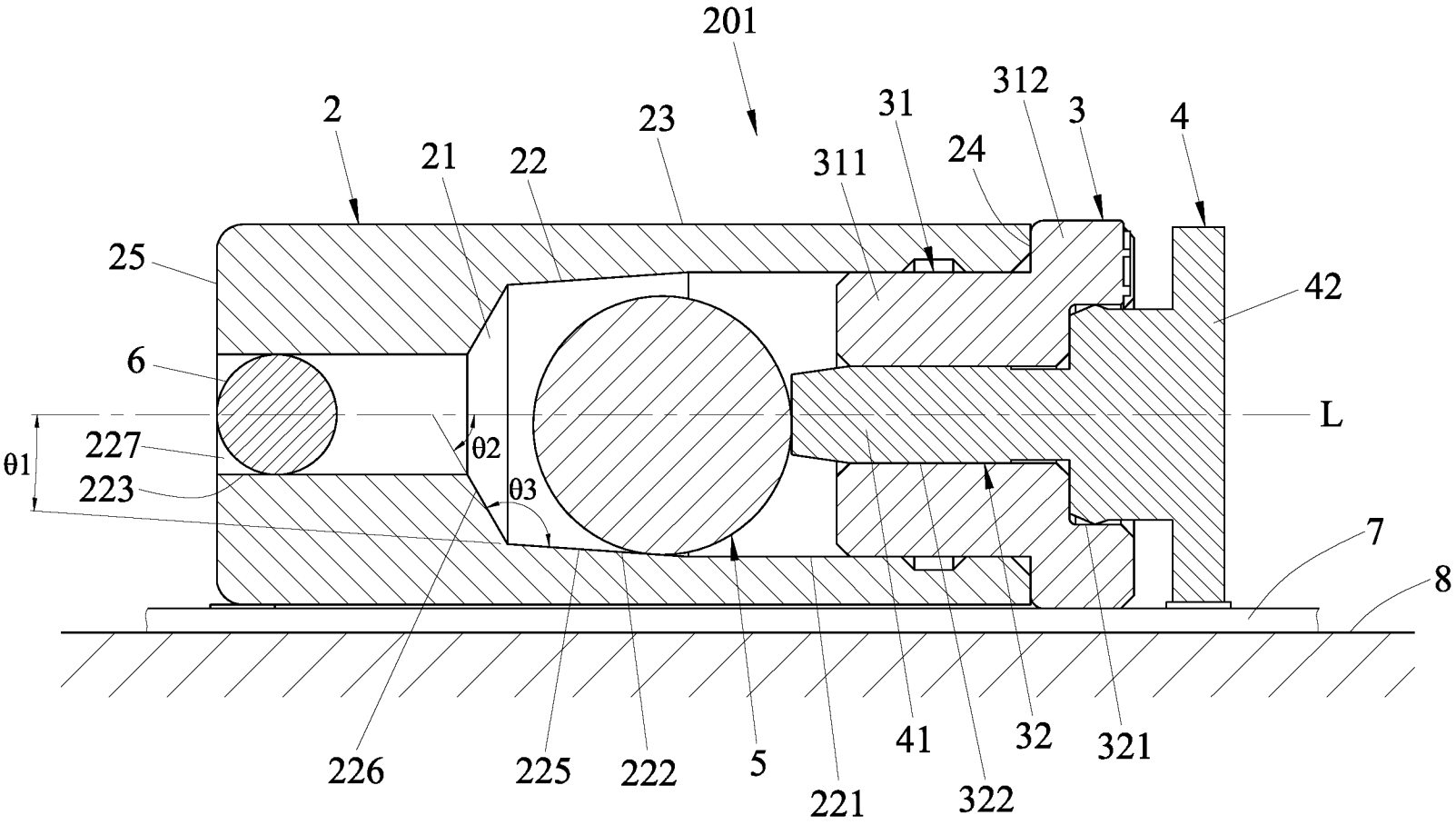
FIG. 4 is a sectional view illustrating the first embodiment in a conducting position.
Figure 5:
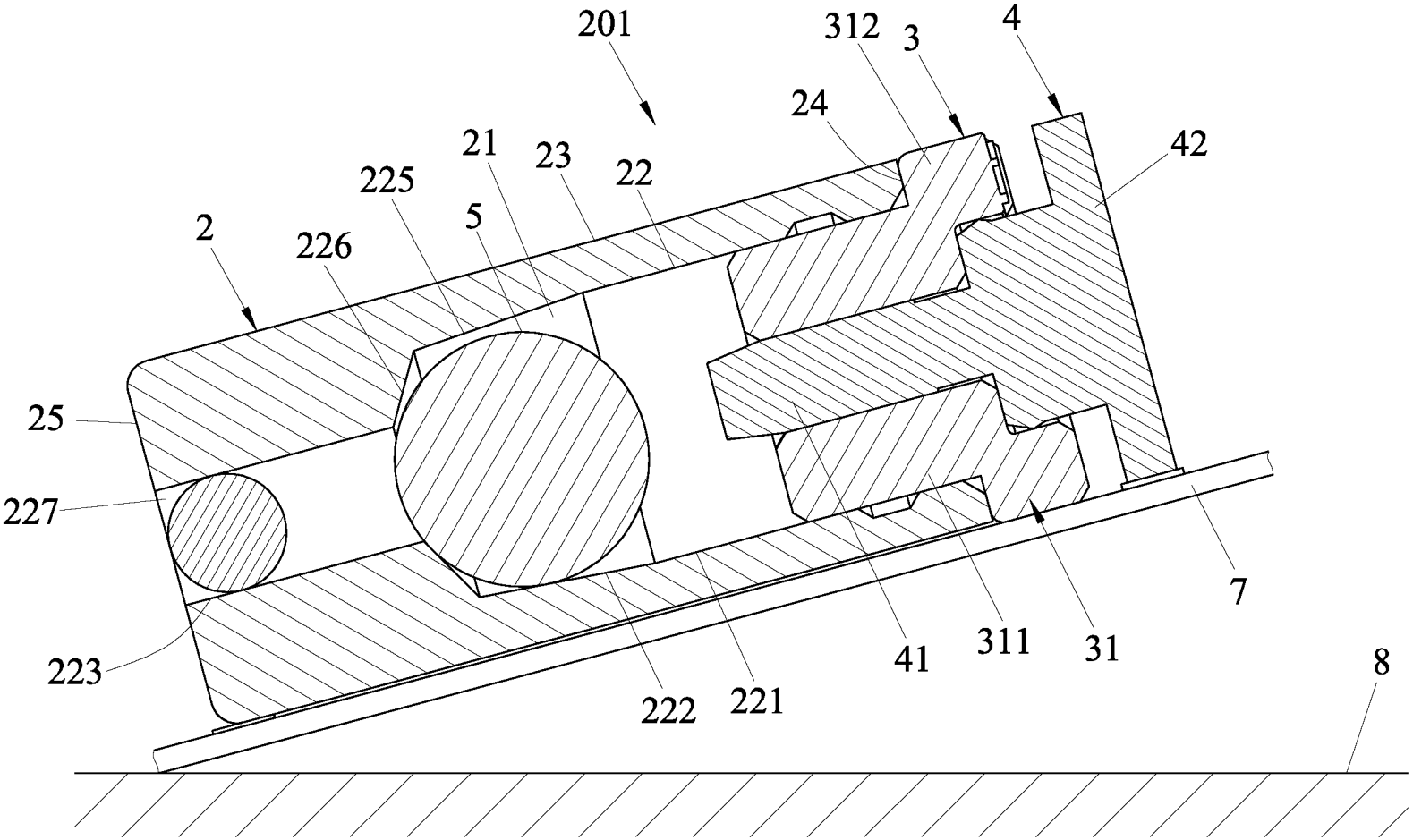
FIG. 5 is a sectional view illustrating the first embodiment in a non-conducting position.

Referring to FIGS. 4 and 5, in this embodiment, the ball unit 5 is configured as a conductive rolling ball and is disposed in the roller cavity 21. The ball unit 5 is movable along the second surface portion 222 of the inner surface 22 between a conducting position (see FIG. 4), where the ball unit 5 is concurrently in contact with the protruding section 41 of the conductive terminal 4 and the second surface portion 222, and a non-conducting position (see FIG. 5), where the ball unit 5 is separated from the protruding section 41 of the conductive terminal 4.

During manufacturing of the rolling-ball tilt switch 201, an electroplating process is used on the rolling-ball tilt switch 201. The inner surface 22 of the conductive housing 2 further has a third surface portion 223 that extends from the second section 226 of the second surface portion 222 along the longitudinal axis (L) to the distal end surface 25, and that defines an oculus 227. The oculus 227 prevents electroplating solution from accumulating in the conductive housing 2 by providing an outlet for the electroplating solution to drain out. The plugging sphere 6 is disposed in the oculus 227 and seals the oculus 227 after the electroplating process.

In this embodiment, the rolling-ball tilt switch 201 has the conductive terminal 4 cooperating with the insulating seat 3 to seal the end of the roller cavity 21 adjacent to the rim end surface 24, and the plugging sphere 6 to seal the oculus 227, thereby sealing opposite ends of the roller cavity 21. This creates an airtight and watertight seal so that the roller cavity 21 of the conductive housing 2 is isolated from the external environment, and the ball unit 5 therein can be protected from corrosion and rust.

When the rolling-ball tilt switch 201 is to be used, it is electrically connected to the circuit board 7 and placed on the reference surface 8. In the first embodiment, when the rolling-ball tilt switch 201 is placed in a state where the longitudinal axis (L) is parallel to the reference surface 8, the ball unit 5 is in the conducting position. When the rolling-ball tilt switch 201 and the circuit board 7 are tilted relative to the reference surface 8 to another state where the longitudinal axis (L) is tilted at an angle of more than 4 degrees relative to the reference surface 8, the ball unit 5 will then move to the non-conducting position to be separated from the protruding section 41 of the conductive terminal 4. When the rolling-ball tilt switch 201 is tilted at an angle of less than 4 degrees relative to the reference surface 8, the ball unit 5 will remain to be in the conducting position. Therefore, the rolling-ball tilt switch 201 according to the present disclosure can remain in the conducting state under a range of tilt angles.

Referring to FIG. 4, the first section 225 and second section 226 of the second surface portion 222 form a third angle (θ3) that ranges from 110 to 130 degrees. In this embodiment, the third angle (θ3) is equal to the value of the first angle (θ1) plus 180 degrees then subtracted by the second angle (θ2). In this embodiment, the third angle (θ3) is substantially 124 degrees; the function of the third angle (θ3) is to prevent the ball unit 5 from being stuck between the first section 225 and the second section 226 of the second surface portion 222 so that the ball unit 5 can smoothly transition from the conducting position to the non-conduction position.

Figure 6:
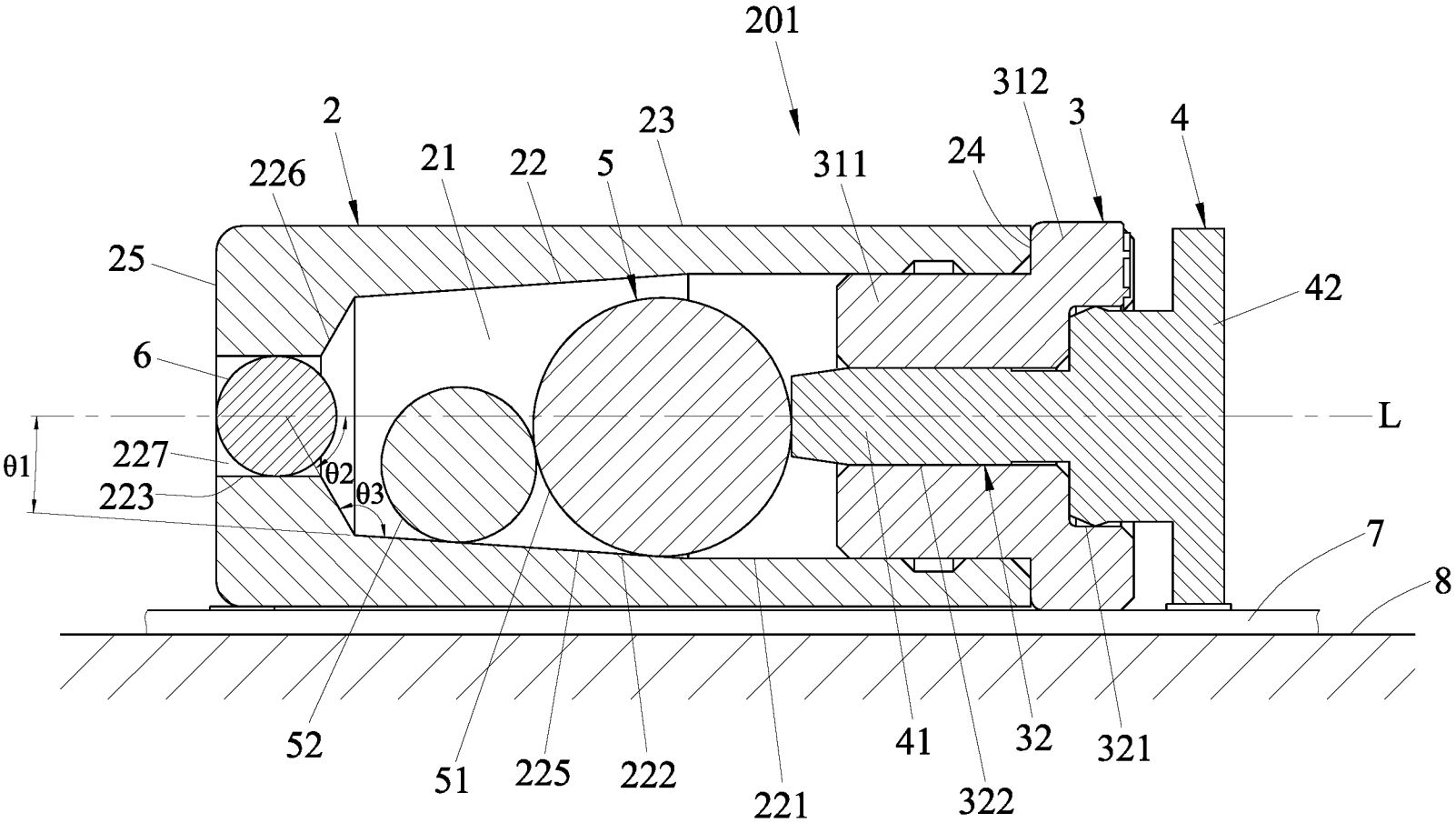
FIG. 6 is a sectional view illustrating a second embodiment of the rolling-ball tilt switch in the conducting position.
Figure 7:
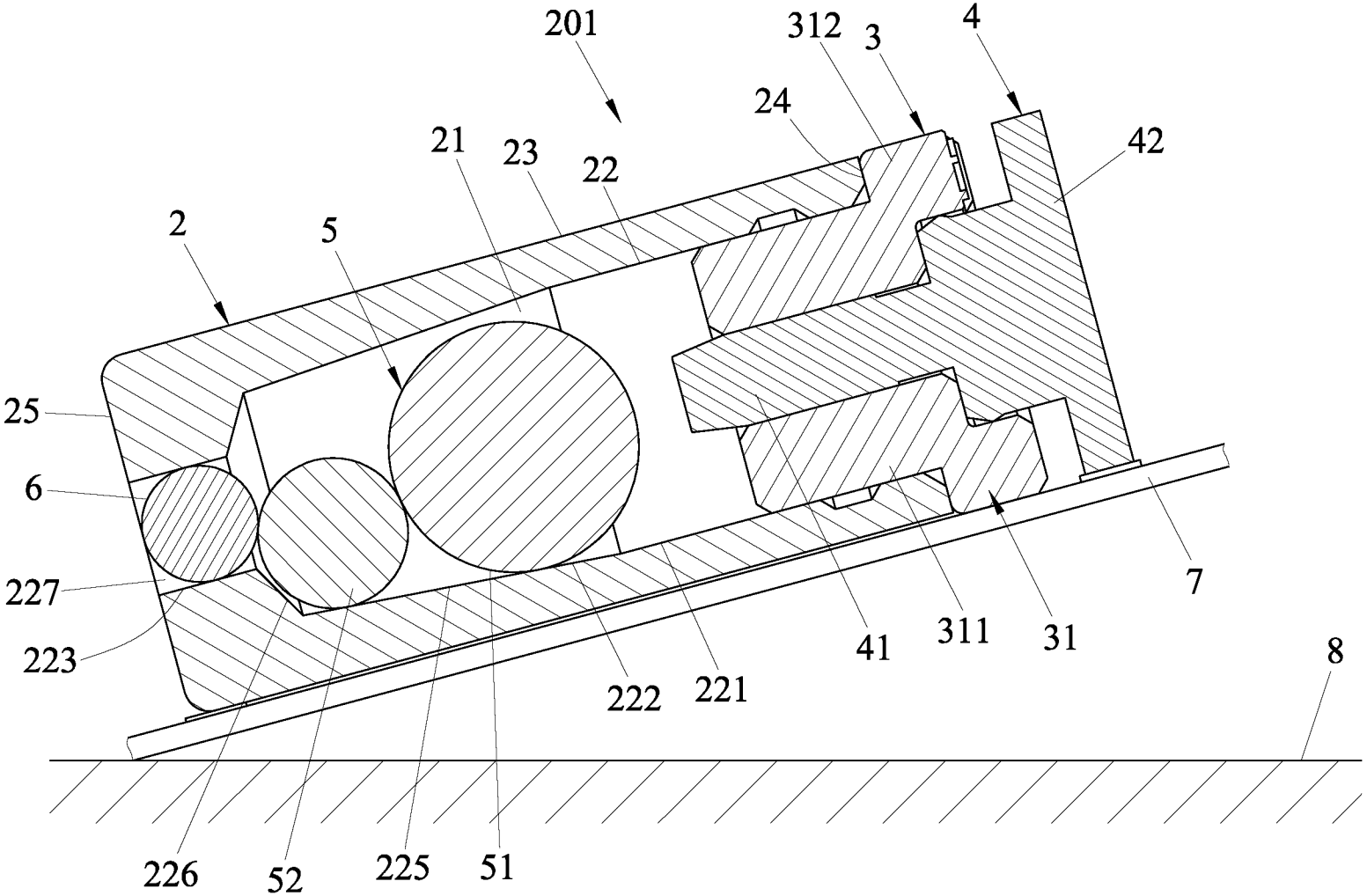
FIG. 7 is a sectional view illustrating the second embodiment in the non-conducting position.

Referring to FIGS. 6 and 7, a second embodiment of the rolling-ball tilt switch 201 according to the disclosure is shown. The second embodiment is similar to the first embodiment, and the difference between the first embodiment and the second embodiment lies in the ball unit 5. In the second embodiment, the ball unit 5 includes a large conductive ball 51, and a small conductive ball 52 that is disposed between the large conductive ball 51 and the distal end surface 25 of the conductive housing 2, and that is smaller than the large conductive ball 51. In the second embodiment, when the ball unit 5 is in the conducting position, the large conductive ball 51 is concurrently in contact with the small conductive ball 52, the protruding section 41 of the conductive terminal 4, and the second surface portion 222 of the inner surface 22 of the conductive housing 2. When the ball unit 5 is in the non-conducting position, the large conductive ball 51 is separated from the protruding section 41 of the conductive terminal 4. The second embodiment can accomplish the same goals and achieve the same effects as the first embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A rolling-ball tilt switch adapted to be electrically connected to a circuit board that is on a reference surface, said rolling-ball tilt switch comprising:

a conductive housing adapted to be secured to the circuit board, and having an inner surface that is adapted to surround a longitudinal axis parallel to the circuit board, and that defines a roller cavity, an outer surface that surrounds and is opposite to said inner surface, a rim end surface that interconnects said inner surface and said outer surface, and a distal end surface that interconnects said inner surface and said outer surface, and that is opposite to said rim end surface along the longitudinal axis, said inner surface having a first surface portion that is adjacent to said rim end surface, and a second surface portion that extends from said first surface portion along the longitudinal axis towards said distal end surface, and that has a first section connected to said first surface portion and gradually converging towards said distal end surface, and a second section connected to an end of said first section which is opposite to the first surface portion, and gradually converges towards said distal end surface, the longitudinal axis and an extension of said first section of said second surface portion of said inner surface cooperatively defining a first angle that ranges from 2 to 12 degrees, the longitudinal axis and an extension of said second section of said second surface portion of said inner surface cooperatively defining a second angle that is not larger than 90 degrees and that is larger than the first angle;

an insulating seat connected to said rim end surface and fittingly inserted into said roller cavity;

a conductive terminal having a protruding section extending through said insulating seat into said roller cavity and cooperating with said insulating seat to seal an end of said roller cavity adjacent to said rim end surface; and a ball unit disposed in said roller cavity, and movable along said second surface portion between a conducting position, where said ball unit is concurrently in contact with said protruding section of said conductive terminal and said second surface portion, and a non-conducting position, where said ball unit is separated from said protruding section of said conductive terminal.

2. The rolling-ball tilt switch as claimed in claim 1, wherein said ball unit is configured as a conductive rolling ball.

3. The rolling-ball tilt switch as claimed in claim 1, wherein said second angle ranges from 60 to 80 degrees.

4. The rolling-ball tilt switch as claimed in claim 3, wherein said second angle is substantially 60 degrees.

5. The rolling-ball tilt switch of claim 1, wherein:

said ball unit includes a large conductive ball, and a small conductive ball that is disposed between said large conductive ball and said distal end surface of said conductive housing, and that is smaller than said large conductive ball;

when said ball unit is in the conducting position, said large conductive ball is concurrently in contact with said small conductive ball, said protruding section of said conductive terminal, and said second surface portion of said inner surface of said conductive housing; and when said ball unit is in the non-conducting position, said large conductive ball is separated from said protruding section of said conductive terminal.

6. The rolling-ball tilt switch of claim 1, wherein:

said first angle is substantially 4 degrees;

when said rolling-ball tilt switch is placed in a state where the longitudinal axis is parallel to the reference surface, said ball unit is in the conducting position; and when said rolling-ball tilt switch is placed in another state where the longitudinal axis is tilted at an angle of more than 4 degrees relative to the reference surface, said ball unit is in the non-conducting position.

7. The rolling-ball tilt switch as claimed in claim 1, wherein said first section and said second section of said second surface portion form an third angle that ranges from 110 to 130 degrees.

8. The rolling-ball tilt switch as claimed in claim 1, wherein:

said inner surface of said conductive housing further has a third surface portion that extends from said second section of said second surface portion along the longitudinal axis to said distal end surface, and that defines an oculus; and said rolling-ball tilt switch further comprises a plugging sphere that is disposed in said oculus and that seals said oculus and said roller cavity from the external environment.

9. The rolling-ball tilt switch as claimed in claim 1, wherein:

said insulating unit has a base body that surrounds the longitudinal axis and an insertion hole that extends along the longitudinal axis through said base body; and said base body has an annular plug section that is inserted into said roller cavity and that abuts against said first surface portion of said inner surface, and an annular sealing section that is connected to said annular plug section, that has a diameter larger than that of said annular plug section, and that abuts against said rim end surface.

10. The rolling-ball tilt switch as claimed in claim 9, wherein:

said insertion hole is a stepped hole, and has a large hole section that is formed in said annular sealing section of said base body, and a small hole section that has a diameter smaller than a diameter of said large hole section, and that extends from said large hole section, through said annular plug section of said base body, into said roller cavity;

said conductive terminal further has a terminal head that is fittingly inserted into said large hole section of said insertion hole, and that has a diameter larger than that of said protruding section; and said protruding section of said conductive terminal extends from said terminal head through said small hole section of said insertion hole into said roller cavity.

* * * * *